US005452812A

United States Patent [19]

Niequist et al.

[11] Patent Number: 5,452,812

[45] Date of Patent: Sep. 26, 1995

[54] SHELVING SYSTEM

[75] Inventors: Kent E. Niequist, St. Charles; Joseph J. Ferraro, Rockford; Dale W. Voelz, St. Charles, all of Ill.

[73] Assignee: Sycamore Systems, Inc., Sycamore, Ill.

[21] Appl. No.: 90,816

[22] Filed: Jul. 13, 1993

[51] Int. Cl.[6] ..... B66C 23/42

[52] U.S. Cl. ..... 211/187; 108/107

[58] Field of Search ..... 211/187, 192, 211/191; 108/107

[56] References Cited

U.S. PATENT DOCUMENTS

| | | | |
|---|---|---|---|
| 540,435 | 6/1895 | Godfrey . | |
| 541,678 | 6/1895 | Poindexter . | |
| 994,674 | 6/1911 | Hansen . | |
| 1,009,679 | 11/1911 | McFadden . | |
| 2,825,470 | 3/1958 | Dublin | 211/187 X |
| 2,915,196 | 12/1959 | Pira . | |
| 3,104,627 | 9/1963 | Fohn . | |
| 3,174,592 | 3/1965 | Berman et al. . | |
| 3,200,775 | 8/1965 | Peters . | |
| 3,272,345 | 9/1966 | Wallace | 211/187 X |
| 3,276,400 | 10/1966 | Brunette | 211/187 X |
| 3,592,345 | 7/1971 | Featherman . | |
| 3,606,024 | 9/1971 | Mieville . | |
| 3,693,556 | 9/1972 | Rous . | |
| 3,807,572 | 4/1974 | Luvara et al. . | |
| 3,892,189 | 7/1975 | Killam . | |
| 4,013,254 | 3/1977 | Boundy et al. . | |
| 4,074,812 | 2/1978 | Skubic et al. . | |
| 4,106,630 | 8/1978 | Rosenband . | |
| 4,193,650 | 3/1980 | Gray et al. . | |
| 4,197,952 | 4/1980 | De Fouw et al. . | |
| 4,250,815 | 2/1981 | Swanson . | |
| 4,265,500 | 5/1981 | Berton et al. . | |
| 4,317,523 | 3/1982 | Konstant et al. . | |
| 4,342,397 | 8/1982 | Halstrick . | |
| 4,343,244 | 8/1982 | Moriarty et al. . | |
| 4,344,367 | 8/1982 | Merl . | |
| 4,423,978 | 1/1984 | Tiegelmann . | |
| 4,467,729 | 8/1984 | Featherman . | |
| 4,500,146 | 2/1985 | Peterson . | |
| 4,519,511 | 5/1985 | Mendenhall . | |
| 4,595,105 | 6/1986 | Gold . | |
| 4,693,383 | 9/1987 | Fenwick . | |
| 4,729,484 | 3/1988 | McConnell . | |
| 4,778,067 | 10/1988 | Bellerose . | |
| 4,821,649 | 4/1989 | Andersson . | |
| 4,850,285 | 7/1989 | Suttles . | |
| 4,874,148 | 10/1989 | Guinter . | |

(List continued on next page.)

OTHER PUBLICATIONS

Oct. 1, 1991 Price List of Barkley/Division of Murray Envelope Corporation for Spaceplus system. (pp. 6–7).

Dec. 1, 1991 Price List of Barkley/Division of Murray Envelope Corporation for Spaceplus system. (pp. 6–7).

Aurora Brochure for QUI–Lok Shelving.

Brochure for Elecompack Shelving.

*Primary Examiner*—J. Franklin Foss

*Attorney, Agent, or Firm*—Emrich & Dithmar

[57] ABSTRACT

Open frame shelving includes upright posts including corner posts and center posts, single-depth and double-depth shelves, horizontal shelf supports and backstops. The corner posts have open, box-like, transverse cross sections with rectangular vertically spaced slots in the end walls thereof and with tapered, vertically spaced slots in the spaced inner walls thereof. Each shelf support has tabs at the opposite ends thereof projecting perpendicular to the axis and engageable in the tapered slots of the corner posts. Backstops extend parallel to the shelf supports and have tabs at their opposite ends engageable in the rectangular slots in the corner posts or in similar slots in the center posts. Single-depth shelves are supported between a shelf support and a backstop, and double-depth shelves are supported between two shelf supports, and may be provided with a reinforcing bar extending between the shelf supports. The arrangement permits a double-depth, double-entry configuration with single-depth shelves at staggered levels and double-depth shelves, and with unobstructed pass through on the double-depth shelves.

21 Claims, 3 Drawing Sheets

U.S. PATENT DOCUMENTS 4,903,847 2/1990 Duffy .
4,928,834 5/1990 Neiman .
4,971,281 11/1990 Steinbeck .
4,996,929 3/1991 Saal .
5,167,191 12/1992 Muth .
5,167,332 12/1992 Schroter .
5,188,333 2/1993 Schumacher et al. .
5,190,172 3/1993 Tyson .
5,295,446 3/1994 Schöfer ..... 211/187 X 25
26
30
31
32
33
34
35
36
38
40
41
42
43
44
45
47
67
68
70
71
72
73
74
75
80
81
82
83
84
85
86
87
89
90
91
92
93
94

40
41
42
43
44
45
46
47
48
49

30
31
32
33
34
35
36
37
38
40
42
43
44
46
47
49
67
8
90
91
92
93
94

31
32
33
34
35
36
37
40
42
43
44
45
46
47
48
49a
67

SHELVING SYSTEM

BACKGROUND OF THE INVENTION

1. Field of the Invention

The present invention relates to erectable metal shelving of the open-frame type.

2. Description of the Prior Art

Various types of open-frame shelving have heretofore been provided. These shelving arrangements may be of the four-post type with upright posts at the four corners of a rectangular configuration and shelves spanning the full area of the rectangular configuration and supported from the corner posts, either directly or via shelf supports. Six-post constructions include center posts at the opposite ends of the configuration, to permit effectively doubling the depth of the configuration from front to back.

One such prior system is marketed by the Barkley Division of Murray Envelope Corporation under the trademark SPACE PLUS. This double-depth arrangement may include double-depth shelves supported on horizontal shelf supports at the front and rear sides of the configuration, with the shelves being rigidified by center reinforcements which extend between the center posts and depend a substantial distance below the shelf, thereby impairing pass-through on the underlying shelf. Another version of this double-depth system utilizes single-depth shelves, each of which is supported between a shelf support at the outer side of the shelf and a backstop member at the inner side thereof. Such single-depth shelves at the front and rear sides of the configuration may be at staggered vertical levels or may be arranged at the same level. However, because they are supported by upstanding backstops at their inner sides, pass through from front to back is prohibited.

These two versions of this prior system have different center posts and do not permit both single-depth and double-depth shelves in the same system.

SUMMARY OF THE INVENTION

It is a general object of the invention to provide an improved shelving system which avoids the disadvantages of prior systems while affording additional structural and operating advantages.

An important feature of the invention is the provision of shelving of the type set forth which can be arranged in either single-depth or double-depth configurations.

In connection with the foregoing feature, another feature of the invention is the provision of shelving of the type set forth which, in a double-depth configuration, can accommodate both single-depth and double-depth shelves without obstructing pass-through on the double depth shelves.

Yet another feature of the invention is the provision of shelving of the type set forth which provides a unique corner post construction to facilitate the flexibility of configuration arrangement.

Still another feature of the invention is the provision of shelving of the type set forth which includes a unique shelf support and shelf reinforcing members which accommodate the flexible configurations of the type described.

A further feature of the invention is the provision of shelving of the type set forth which is of relatively simple and economical construction and is characterized by ease of assembly, without the use of sway braces, nuts or bolts.

These and other features of the invention are attained by providing shelving in a rectangular configuration having front and back sides and opposed ends, the shelving comprising: a plurality of upright posts each having vertically spaced slots, the posts including four corner posts respectively disposed at the corners of the configuration and two center posts respectively disposed substantially midway between the corner posts at the opposed ends of the configuration, a plurality of first shelves each having a front-to-back depth approximately equal to the distance between a corner post and a center post at the same end of the configuration, a plurality of second shelves each having a front-to-back depth approximately equal to the distance between corner posts at the same end of the configuration, first horizontal support members for interconnecting corner posts along the same side of the configuration and each including first tab members engageable in slots of the corner posts for selective mounting at any of a plurality of vertical levels, second horizontal support members for interconnecting the center posts and each including second tab members engageable in slots of the center posts for selective mounting at any of the plurality of vertical levels, each of the first shelves being supportable between one of the first shelf support members and one of the second shelf support members, each of the second shelves being supportable between two of the first shelf support members respectively disposed at the front and back sides of the configuration, and reinforcing members supported by the posts and disposed to inhibit buckling of the second shelves, each of the first horizontal support members and the reinforcing members cooperating with a second shelf supported thereby so as not to extend substantially above or below the shelf, thereby avoiding obstruction of the second shelf or any underlying shelf.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
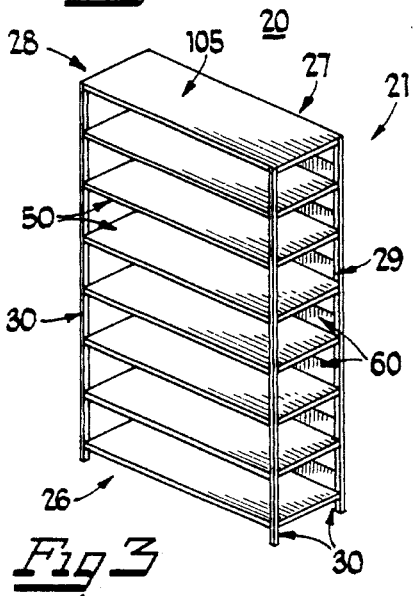
Figure 2:
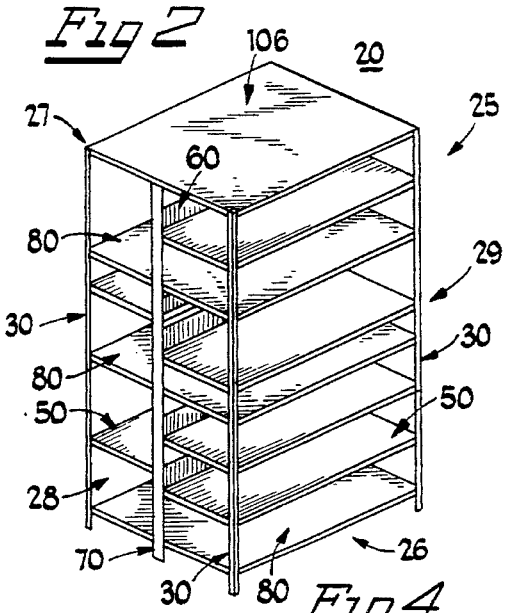
Figure 3:
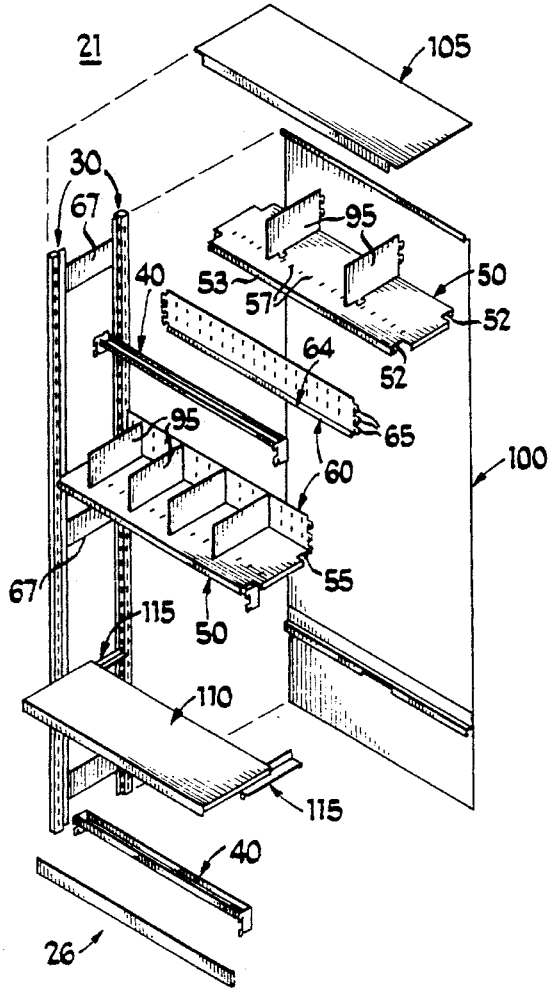
Figure 4:
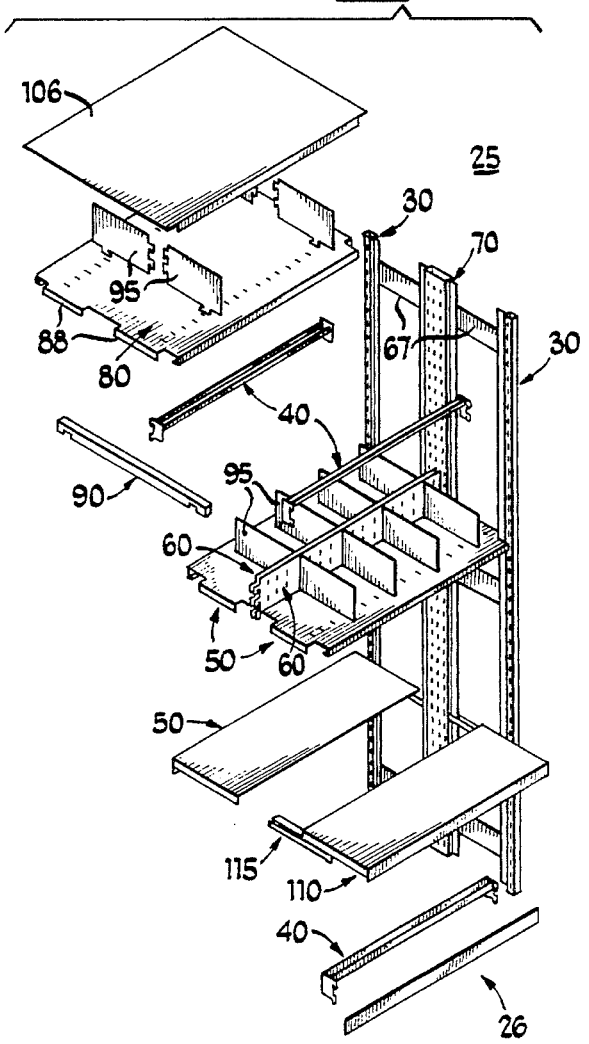
Figure 5:
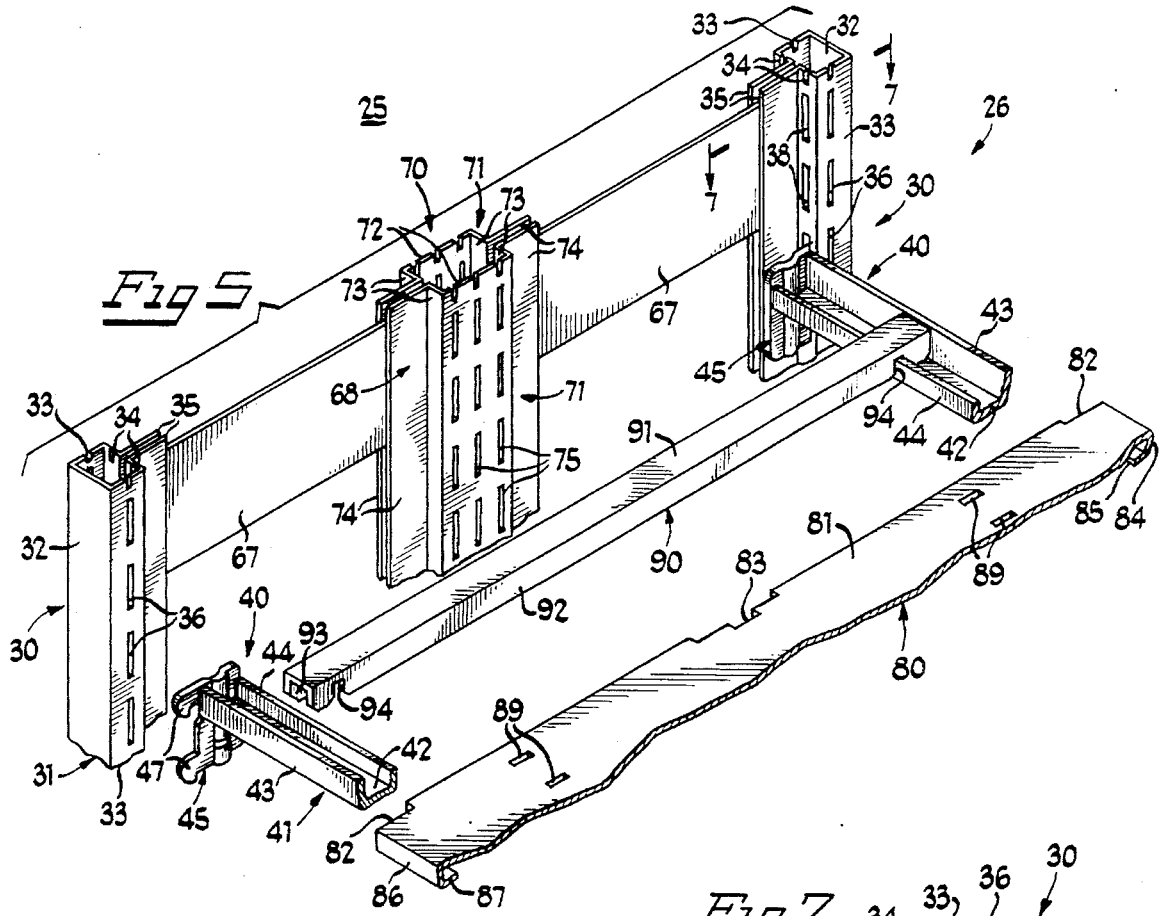
Figure 6:
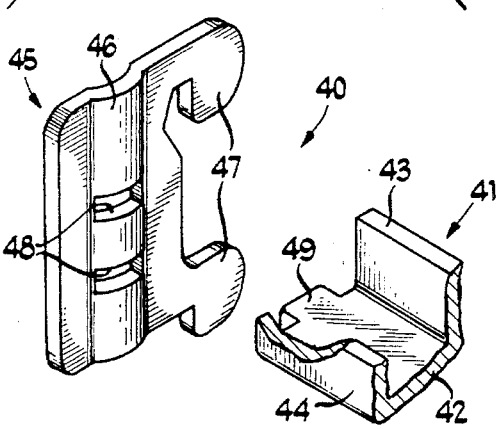
Figure 7:
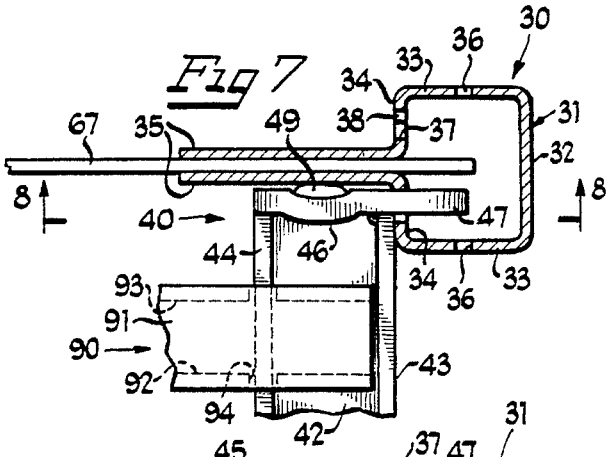
Figure 8:
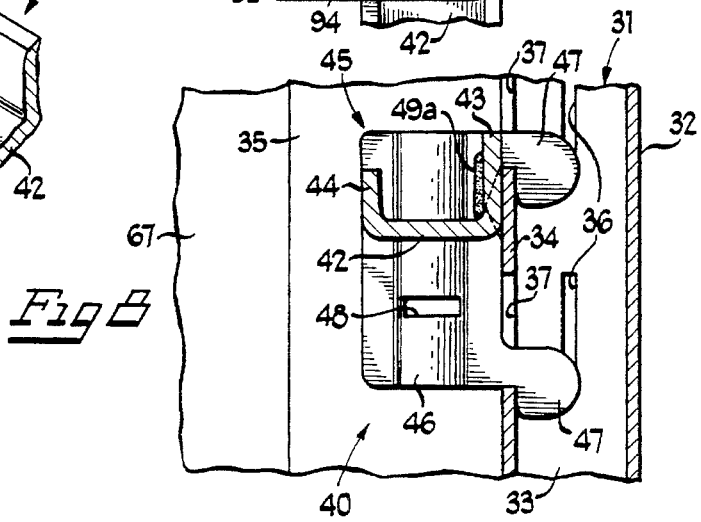
Figure 9:
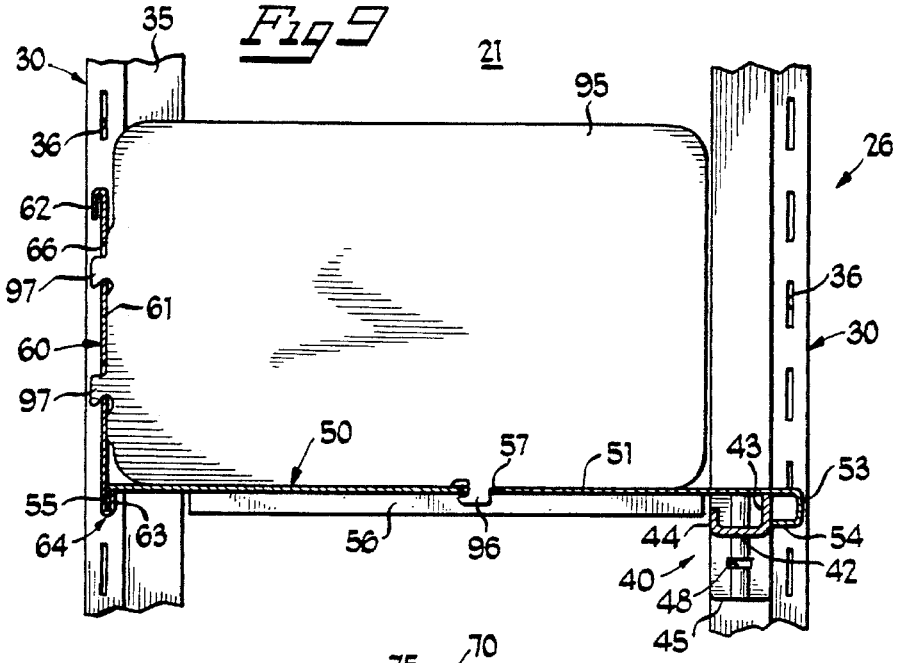
Figure 10:
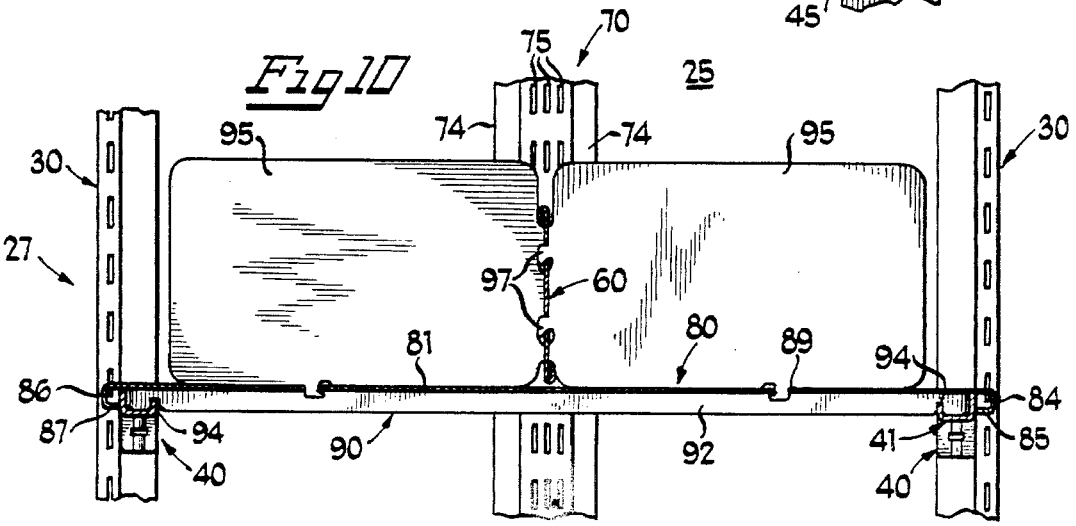
Figure 11:
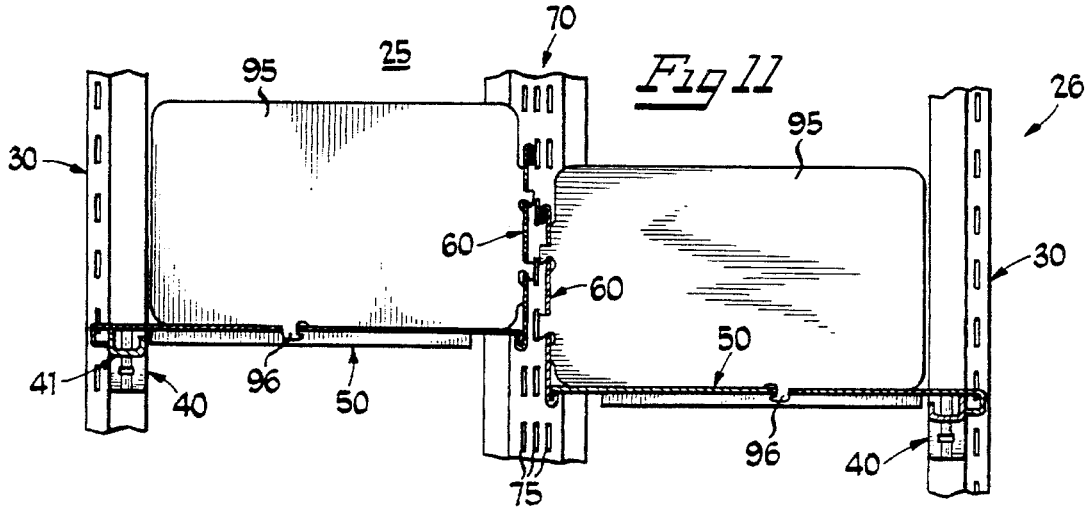

FIG. 1 is a perspective view of shelving in accordance with the present invention arranged in a single-depth configuration;

FIG. 2 is a perspective view of shelving in accordance with the present invention arranged in a double-depth configuration with both single-depth and double-depth shelves;

FIG. 3 is an enlarged, fragmentary, partially exploded view of the shelving of the present invention arranged in a single-entry, single-depth configuration similar to that of FIG. 1;

FIG. 4 is an enlarged, fragmentary, partially exploded view of shelving of the present invention arranged in a double-entry, single-depth and double-depth configuration similar to that of FIG. 2;

FIG. 5 is a further enlarged, fragmentary, partially exploded, rear perspective view of a double-depth configuration of the shelving of the present invention with a double-depth shelf;

FIG. 6 is a further enlarged, fragmentary, exploded, rear perspective view of one end of a shelf support member in accordance with the present invention;

FIG. 7 is a further enlarged, fragmentary view in horizontal section, taken along the line 7—7 in FIG. 5;

FIG. 8 is a fragmentary view in vertical section taken along the line 8—8 in FIG. 7;

FIG. 9 is a fragmentary view in vertical section of a single-depth configuration of the shelving of the present invention, illustrating a divider on the shelf;

FIG. 10 is a reduced view similar to FIG. 9 of a double-depth configuration of the shelving of the present invention, illustrating a double-depth shelf with single-depth dividers coupled to a backstop member; and FIG. 11 is a view similar to FIG. 10 of a double-depth configuration of the shelving of the present invention with two staggered-level single-depth shelves with dividers thereon.

DESCRIPTION OF THE PREFERRED EMBODIMENT

Referring to FIGS. 1 and 2, there is illustrated shelving 20 constructed in accordance with the present invention, FIG. 1 illustrating a single-depth configuration 21 and FIG. 2 illustrating a double-depth, double-entry configuration 25. Each of the configurations 20 and 25 has a front side 26, a back side 27 and opposed ends 28 and 29.

Referring also to FIG. 3, the single-depth configuration 21 is a "four-post" arrangement, including four upstanding corner posts 30 and a plurality of single-depth shelves 50 which are supported from the corner posts 30. More specifically, each shelf 50 is supported between a horizontal shelf support 40 at the front side thereof and a backstop 60 at the back side thereof.

Referring also to FIG. 4, the double-depth configuration 25 includes four of the corner posts 30 with the front side ones thereof spaced twice as far from the rear side ones thereof as in the single-depth configuration 21, resulting in twice the depth of the overall configuration. Disposed midway between the front side and rear side ones of the corner posts 30, respectively at the opposite ends 28 and 29 of the configuration 25, are upstanding center posts 70. The configuration 25 includes single-depth shelves 50 which are supported between the center posts 70 and either the front side ones or the back side ones of the corner posts 30 by means of the shelf supports 40 and the backstops 60, as described above. The configuration 25 also includes double-depth shelves 80, which are supported on shelf supports 40 respectively disposed at the front and back sides 26 and 27 of the configuration. It is a significant aspect of the invention that, in this double-depth configuration 25, both single-depth shelves 50 and double-depth shelves 80 are accommodated without obstructing pass-through on the double-depth shelves 80 from the front side to the back side thereof.

Referring now in particular to FIGS. 5, 7 and 8, each of the corner posts 30 has a body 31 of unitary, one-piece construction, which has a substantially open box-like transverse cross section. More specifically, the body 31 includes a rectangular outer wall 32 integral at its opposite ends with parallel, inwardly extending end walls 33, which are, respectively, integral at their inner ends with substantially coplanar inner walls 34. The inner walls 34 extend toward each other and are, respectively, integral with spaced-apart and parallel flanges 35 which extend away from the outer wall 32 substantially perpendicular thereto. Each of the end walls 33 is provided with a single vertical row of equidistantly spaced-apart rectangular slots 36. Each of the inner walls 34 is provided with a vertical row of equidistantly spaced apart slots 37, each of which is generally rectangular in shape but has a tapered lower end 38 (see FIG. 5).

Referring also to FIG. 6, each of the shelf supports 40 includes an elongated, channel-shaped beam 41 having a rectangular bottom wall 42 integral along its sides with upstanding, substantially parallel outer and inner flanges 43 and 44, with the outer flange 43 preferably being somewhat longer than the inner flange 44. Respectively fixedly secured to the opposite ends of the beam 41 are coupling brackets 45, each of which is a plate-like member having vertically spaced-apart, hook-shaped tabs 47 projecting from one end thereof in the plane thereof. Each bracket 45 has a part-cylindrical recess portion 46 deformed out of the plane thereof and having a longitudinal axis extending substantially perpendicular to the direction of projection of the tabs 47, the recess portion 46 having two substantially rectangular and spaced-apart slots 48 formed therethrough. The bottom wall 42 of the beam 41 is provided at each end thereof with an outwardly projecting tab 49, which is dimensioned to be received in either one of the slots 48 in the coupling bracket 45 to facilitate positioning of the brackets 45 relative to the beam 41 prior to fixedly securing them together, as by weldments 49*a* (see FIG. 8). Preferably, the outer flange 43 of the beam 41 has a height such that, when assembled, it is substantially coplanar with the top edges of the brackets 45. Thus, it will be appreciated that the height of the flange 43 will vary depending on which bracket slot 48 the beam 41 is aligned with.

It can be seen that the tabs 47 project from the assembled shelf support 40 substantially perpendicular to the longitudinal axis of the beam 41. It will be appreciated that the tabs 47 are shaped and dimensioned to be received in locking engagement in vertically adjacent ones of the slots 47 in one of the corner post inner walls 34, as is illustrated in FIGS. 5, 7 and 8. The length of the shelf support 40 is such that it extends between adjacent corner posts 30 along either the front side or the back side of the configuration 21 or 25.

Each of the single-depth shelves 50 includes a rectangular plate 51 defining the shelf platform and provided with corner notches or cutouts 52 (see FIG. 3) to accommodate the corner posts 30. The plate 51 has a front flange 53 depending from the front edge thereof and integral at its lower edge with a rearwardly extending lip 54, while the rear edge of the plate 51 has a depending rear flange 55. The plate 51 is provided along its opposite end edges with depending end flanges 56 (see FIGS. 3 and 9). If desired, the plate 51 may be provided adjacent to the front edge thereof with a row of equidistantly spaced apart slots 57 for a purpose to be explained more fully below.

Referring to FIGS. 3 and 9–11, each backstop 60 includes a generally rectangular plate 61 disposed vertically in use, and being integral at its top edge with a rearwardly and downwardly bent top lip 62 and being integral at its bottom edge with a forwardly and upwardly bent bottom lip 63 which defines a channel 64. The plate 61 is provided at each end thereof with three vertically spaced hook-shaped tabs 65 (FIG. 3) projecting therefrom in the plane thereof. If desired, the plate 61 may be provided with two vertically spaced rows of equidistantly longitudinally spaced-apart slots 66.

In assembly of the single-depth configuration 21, the front side ones of the corner posts 30 are interconnected by a plurality of horizontally disposed shelf supports 40, one for each shelf 50 in the configuration. Each shelf support 40 has the tabs 47 thereof engaged in slots 37 of the associated corner posts 30, with the outer flange 43 of the beam 41 abutting the inner walls 34 of the corner posts 30, as can best be seen in FIG. 9. Each single-depth shelf 50 rests on top of the associated shelf support 40, with the rear edge of the front flange lip 54 abutting the outer surface of the shelf support outer flange 43, as is best illustrated in FIG. 9. The rear flange 55 of the shelf 50 is hooked into the channel 64 defined by an associated backstop 60, the tabs 65 of which are hooked into three vertically adjacent ones of the corner post slots 36 immediately above the level of the shelf 50, such that the shelf 50 will be disposed substantially horizontally in its mounted position. If desired, end braces 67 may be connected between the front side and the back side ones of the corner posts 30 at each end of the configuration 21. More specifically, a plurality of vertically spaced-apart ones of the end braces 67 may be provided at each end of the configuration 21, each brace 67 being a rectangular plate having the opposite ends thereof receivable between the flanges 35 of the associated corner posts 30 and being fixedly securable thereto, as by weldments (see FIG. 5) or suitable fasteners.

Referring in particular to FIGS. 4, 5, 10 and 11, each of the center posts 70 includes a pair of unitary, one-piece, metal bodies 71, each generally channel-shaped in transverse cross section. More specifically, each of the bodies 71 has a rectangular center wall 72 integral at the side edges thereof with short end walls 73, each of which is integral at its distal end with an outwardly extending flange 74, such that the flanges 74 are substantially coplanar and are substantially parallel to the center wall 72. The center wall 72 is provided with three rows of equidistantly longitudinally spaced-apart rectangular slots 75 therethrough. The bodies 71 are arranged back-to-back with the flanges 74 in facing relationship. The facing flanges 74 of the bodies 71 may be directly secured together, as by weldments 68 or other suitable fasteners, to form the center post 70 which, in use, is disposed with the flanges 74 thereof projecting forwardly and rearwardly of the configuration 25. Alternatively, adjacent ends of end braces 67 may be received between the facing flanges 74 and secured together therewith, as illustrated in FIG. 5.

Each of the double-depth shelves 80 comprises a rectangular plate or platform 81 provided at the corners thereof with corner cutouts or notches 82 for respectively accommodating the corner posts 30. The plate 81 is also provided along each end edge thereof with a center notch 83 shaped to accommodate the associated center post 70. The front edge of the plate 81 is bent downwardly to define a depending front flange 84, the bottom edge of which is bent inwardly to define a rearwardly extending lip 85. Similarly, the rear edge of the plate 81 is bent downwardly to define a depending rear flange 86, the bottom edge of which is bent inwardly to define a forwardly extending lip 87. The side edges of the plate 81 are respectively bent downwardly to define depending end flanges 88 (see FIG. 4). If desired, the plate 81 may be provided, respectively adjacent to the front and back edges thereof, with rows of longitudinally spaced-apart slots 89, for a purpose to be described below.

In use, a double-depth shelf 80 is adapted to be supported between two of the shelf supports 40, as is best illustrated in FIGS. 5 and 10. In this regard, one of the shelf supports 40 is disposed between the corner posts 30 at the front side of the configuration 25, while the other is disposed at the same vertical level between the corner posts 30 at the back side of the configuration 25, with the tabs 47 being engaged in the corner post slots 37 in the same manner as was described above in connection with the configuration 21.

Because of the length of the span between the shelf supports 40, the double-depth shelf 80 may be provided with a reinforcing bar 90, which is an elongated, channel-shaped member having a rectangular top wall 91, provided at the side edges thereof with depending flanges 92 and 93. Each of the flanges 92 and 93 is provided adjacent to the opposite ends of the bar 90 with laterally aligned notches 94 in the bottom edges thereof. In use, the notches 94 receive the inner flanges 44 of the shelf supports 40, as is clearly shown in FIG. 5, for supporting the reinforcing bar 90 between the shelf supports 40. Preferably, the reinforcing bar 90 will be disposed intermediate the ends of the configuration 25, and it will be appreciated that, if desired, more than one reinforcing bar 90 could be used for each double-depth shelf 80. The shelf 80 rests upon the shelf supports 40 (and upon the reinforcing bar 90, if one is used) with the inner edges of the lips 85 and 87, respectively, disposed for abutting relationship with the outer surfaces of the outer flanges 43 of the shelf supports 40 (see FIG. 10).

It is a significant aspect of the invention that the channel beams 41 of the shelf supports 40 and the reinforcing bars 90 are relatively shallow and, more specifically, do not extend substantially below the lips 54 of the single-depth shelves 50 and the lips 85 and 87 of the double-depth shelves 80. Thus, the upper surfaces of the shelf platforms 51 and 81 are completely unobstructed by the supporting structure and the supporting structure does not extend appreciably below the shelves 50 and 80, so as not to obstruct pass through on an underlying shelf. Thus, front-to-back pass through on the double-depth shelves 80 is unobstructed by the shelf supporting structure.

Furthermore, it will be noted that the unique construction of the corner posts 30, the center posts 70, the shelf supports 40 and the reinforcing bars 90 affords great flexibility in configuration of the shelving 20, while using standardized parts. Thus, the single-depth configuration 21 may have the shelves 50 thereof supported between a shelf support 40 and a backstop 60, as described above or, alternatively, if double entry to the configuration is desired, the shelves 50 may be supported between two of the shelf supports 40, in the same manner as was described above with the double-depth shelves 80. Furthermore, as was indicated above, the double-depth configuration 25 may include both single-depth shelves 50 and double-depth shelves 80, and the single-depth shelves 50 may be disposed in the front and back halves of the configuration, at either the same level or at staggered levels. In this configuration, the single-depth shelves 50 have their inner ends supported on backstops 60, as indicated in FIG. 11. This arrangement being accommodated by the three rows of slots 75 in the center posts 70.

Referring in particular to FIGS. 3, 4, and 9–11, if desired, the shelves 50 and 80 may be provided with dividers 95 to longitudinally divide the shelves into individual storage compartments, in a known manner. Each of the dividers 95 is a flat, substantially rectangular plate arranged to be disposed vertically in use. In order to use dividers 95, the shelves 50 and 80 must be slotted. Each divider 95 is provided at its lower edge with a depending hook-like tab 96 adapted to be received in one of the slots 57 of a single-depth shelf 50 or one of the slots 89 in a double-depth shelf 80.

Each divider 95 is provided at its inner edge with a pair of vertically spaced-apart hook-like tabs 97 adapted to be engaged in vertically aligned slots in a backstop 60. Thus, it will be appreciated that the dividers 95 can only be used on a single-depth shelf 50, the rear end of which is supported on a backstop 60. If the dividers 95 are to be used on a double-depth shelf 80, a backstop 60 must be positioned between the center posts 70 immediately above the shelf platform 81, as illustrated in FIG. 10, to support the inner ends of the dividers 95.

If double-entry from both the front and back sides of the configuration is not important, a back panel 100 (FIG. 3) may be mounted on either of the configurations 21 and 25 for closing the back side 27 of the configuration. Similarly, top panels 105 or 106 for the single-depth and double-depth configurations 21 and 25, respectively, may be provided to close the upper ends of the configurations, as indicated in FIGS. 1–4. If desired, end panels (not shown) could also be provided for closing the ends 28 and 29 of the configurations 21 and 25. It will also be appreciated that, if desired, the shelving may include sliding shelf assemblies 110, of known construction, wherein the shelves are adapted for reciprocating front-to-back sliding movement on slide supports 115 to facilitate access to the shelves.

From the foregoing, it can be seen that there has been provided improved shelving which is of simple and economical construction and which affords unique flexibility of arrangement with standardized parts in either single-depth or double-depth configurations.

We claim:

1. Shelving in a rectangular configuration having front and back sides and opposed ends, said shelving comprising: a plurality of upright posts each having vertically spaced slots, said posts including four corner posts respectively disposed at the corners of the configuration and two center posts respectively disposed substantially midway between the corner posts at the opposed ends of the configuration, a plurality of first shelves each having a front-to-back depth approximately equal to the distance between a corner post and a center post at the same end of the configuration, a plurality of second shelves each having a front-to-back depth approximately equal to the distance between corner posts at the same end of the configuration, first horizontal support members for interconnecting corner posts along the same side of the configuration and each including first tab members engageable in slots of said corner posts for selective mounting at any of a plurality of vertical levels, second horizontal support members for interconnecting said center posts and each including second tab members engageable in slots of said center posts for selective mounting at any of the plurality of vertical levels, each of said first shelves being supportable between one of said first shelf support members and one of said second shelf support members, each of said second shelves being supportable between two of said first shelf support members respectively disposed at the front and back sides of the configuration, and reinforcing members supported by said posts and disposed to inhibit buckling of said second shelves, each of said first horizontal support members and said reinforcing members cooperating with a second shelf supported thereby so as not to extend substantially above or below said shelf, thereby avoiding obstruction of said second shelf or any underlying shelf.

2. The shelving of claim 1, wherein each of said second shelves overlies the associated first support members and reinforcing members.

3. The shelving of claim 1, wherein each of said reinforcing members extends between two of said first support members and is supported thereby.

4. The shelving of claim 1, wherein said first shelves include shelves disposed in the front and back sides of the configuration at staggered vertical levels.

5. The shelving of claim 1, wherein each of said shelves is provided with depending flanges at the front and rear sides and the opposite ends thereof.

6. The shelving of claim 5, wherein said first support members and said reinforcing members are disposed beneath the shelves supported thereby and do not extend substantially below the depending flanges of the supported shelf.

7. An upright post for shelving, said post comprising: a unitary body of substantially open box construction in transverse cross section, said body including an outer wall and a pair of opposed end walls extending from said outer wall and a pair of inner walls respectively extending from said end walls toward each other and terminating at spaced-apart inner ends and a pair of spaced-apart flanges respectively extending from said inner ends, each of said end walls having a plurality of vertically spaced first slots therein, and each of said inner walls having a plurality of vertically spaced second slots therein.

8. The post of claim 7, wherein said end walls are substantially parallel to each other.

9. The post of claim 7, wherein said inner walls are substantially coplanar.

10. The post of claim 7, wherein said flanges are substantially parallel to each other.

11. The post of claim 7, wherein each of said second slots has a tapered construction with downwardly convergent portions.

12. In a shelving construction disposed in a rectangular configuration having front and back sides and opposed ends, the improvement comprising: a plurality of upright posts respectively disposed at the corners of the configuration, each of said posts including a unitary body of substantially open box construction in transverse cross section, said body including an outer wall and a pair of opposed end walls extending from said outer wall and a pair of inner walls respectively extending toward each other from said end walls, each of said end walls having a plurality of vertically spaced first slots therein, each of said inner walls having a plurality of vertically spaced second slots therein; at least one first horizontal support member extending between aligned ones of said posts at opposite ends of the configuration and having a first longitudinal axis, said first support member including first tabs respectively projecting therefrom at the opposite ends thereof in the direction of said axis and adapted for engagement in said first slots of said posts; and at least one second horizontal support member extending between aligned ones of said posts at opposite ends of the configuration and having a second longitudinal axis, said second support member including second tabs respectively projecting therefrom at the opposite ends thereof substantially perpendicular to said axis and adapted for engagement in said second slots of said posts.

13. The shelving of claim 12, wherein said first support member includes a plurality of first tabs at each end thereof.

14. The shelving of claim 12, wherein said second support member includes a plurality of second tabs at each end thereof.

15. The shelving of claim 12, wherein each of said second slots has a tapered configuration with downwardly convergent portions.

16. The shelving of claim 12, and further comprising at least one shelf having front and rear portions respectively supported by said first and second support members.

17. The shelving of claim 12, and further comprising at least two of said first horizontal support members, and at least one shelf having front and rear portions respectively supported by two of said first support members.

18. In a shelving construction disposed in a rectangular configuration having front and back sides and opposed ends, the improvement comprising: a plurality of upright corner posts each having vertically spaced slots therein and respectively disposed at the corners of the configuration, two elongated support members respectively disposed at the front and back sides of the configuration and extending between aligned posts at the opposite ends of the configuration, each of said support members having tabs respectively disposed at the opposite ends thereof and adapted for engagement in the post slots with said support members extending substantially horizontally at the same vertical level, a reinforcing member extending between said support members intermediate the ends thereof, and a shelf overlying said support members and said reinforcing member and supported thereby and extending from the front to the back and from one end to the other of the configuration.

19. The shelving of claim 18, wherein each of said support members is generally channel-shaped in transverse cross section and includes upstanding inner and outer flanges.

20. The shelving of claim 19, wherein said reinforcing member is provided with notches therein respectively adjacent to the opposite ends thereof, said notches being adapted for respectively receiving therein the inner flanges of the associated support members for supporting said reinforcing member on said support members.

21. The shelving of claim 18, and further comprising at least two upright center posts respectively disposed between said corner posts at the opposite ends of the configuration.

* * * * *